US012187472B2

(12) United States Patent
Scrivani

(10) Patent No.: US 12,187,472 B2
(45) Date of Patent: Jan. 7, 2025

(54) APPARATUS AND METHOD FOR FILLING DISPOSABLE CAPSULES FOR THE PREPARATION OF BEVERAGES

(71) Applicant: Rychiger AG, Steffisburg (CH)

(72) Inventor: Massimo Scrivani, Casteggio (IT)

(73) Assignee: Rychiger AG (CH)

( * ) Notice: Subject to any disclaimer, the term of this patent is extended or adjusted under 35 U.S.C. 154(b) by 12 days.

(21) Appl. No.: 18/025,884

(22) PCT Filed: Sep. 15, 2021

(86) PCT No.: PCT/EP2021/075359
§ 371 (c)(1),
(2) Date: Mar. 11, 2023

(87) PCT Pub. No.: WO2022/058368
PCT Pub. Date: Mar. 24, 2022

(65) Prior Publication Data

US 2023/0339638 A1 Oct. 26, 2023

(30) Foreign Application Priority Data

Sep. 15, 2020 (CH) ..... 1160/20
Sep. 15, 2020 (IT) ..... 102020000021781

(51) Int. Cl.
*B65B 29/02* (2006.01)
*B65B 39/12* (2006.01)
(Continued)

(52) U.S. Cl.
CPC ..... *B65B 29/022* (2017.08); *B65B 39/12* (2013.01); *B65B 43/54* (2013.01); *B65B 57/00* (2013.01)

(58) Field of Classification Search
CPC ..... B65B 29/022; B65B 43/54; B65B 39/12; B65B 57/00
See application file for complete search history.

(56) References Cited

U.S. PATENT DOCUMENTS 3,965,656 A * 6/1976 Gerben ..... B65B 7/164 53/329.4
8,403,009 B2 * 3/2013 Noe ..... B65G 47/5127 141/184
(Continued)

FOREIGN PATENT DOCUMENTS

WO WO 2016/088023 A1 6/2016

*Primary Examiner* — Andrew M Tecco
(74) *Attorney, Agent, or Firm* — Lerner David LLP

(57) ABSTRACT

An apparatus for filling disposable capsules for preparation of beverages is disclosed. The apparatus includes a belt production line in continuous advancement comprising a plurality of seats arranged at a constant pitch for housing a plurality of capsules to be filled, a filling unit above the belt production line including a plurality of dosers for dosing food substance, wherein the plurality of dosers is configured in at least one rectilinear row of dosers and the plurality of seats is configured for transit below the filling unit in at least one rectilinear row of seats, in that the plurality of dosers is arranged at a constant pitch greater than the constant pitch of the plurality of housing seats. In addition, a coordinated movement element is envisaged, configured to impose on the rectilinear row of dosers and on said rectilinear row of seats a null relative speed.

10 Claims, 6 Drawing Sheets

(51) Int. Cl.
*B65B 43/54* (2006.01)
*B65B 57/00* (2006.01)

(56) References Cited

U.S. PATENT DOCUMENTS

| | | | | |
|---|---|---|---|---|
| 10,279,938 | B2 * | 5/2019 | Cavazza | B65B 41/06 |
| 2010/0037981 | A1 * | 2/2010 | Noe | B65B 5/103 141/1 |
| 2016/0355286 | A1 * | 12/2016 | Cavazza | B29C 66/849 |

* cited by examiner

APPARATUS AND METHOD FOR FILLING DISPOSABLE CAPSULES FOR THE PREPARATION OF BEVERAGES

CROSS REFERENCE TO RELATED APPLICATIONS

This application is a national phase of international application PCT/EP2021/075359, filed 15 Sep. 2021, which claims the benefit of priority to Italian patent application IT 102020000021781, filed Sep. 15, 2020, and Swiss patent application CH 01160/20, filed Sep. 15, 2020, which the content of each of the aforementioned patent applications being incorporated herein by reference.

BACKGROUND OF THE INVENTION

Field of the Invention

The present invention relates to an apparatus for filling disposable capsules for the preparation of beverages.

Description of Related Art

Disposable capsules for the preparation of beverages, typically coffee, have long been on the market and are easy to handle in machines designed for the preparation of this beverage.

The disposable capsule is generally formed by a waterproof, cup-shaped outer casing, which is filled with food substances, such as soluble or partially soluble coffee powders; the outer casing containing the food substance is then closed at the top with an impermeable film sealed at the edge, generally after replacing and/or enriching the residual air in the container with inert gas to protect the food substance, thus creating the disposable capsule.

The disposable capsule produced in this way is inserted in various ways into the preparation machine, which produces the beverage with its own appropriate incorporated means.

Devices and plants for the manufacture of disposable capsules for the preparation of beverages as described above have been on the market for some time.

It is known that such plants traditionally have successive processing stations along a production line in which the various activities necessary for packaging the finished disposable capsule are subsequently carried out.

One station of the production line is dedicated to filling the capsules with the soluble or partially soluble food substance characterising the beverage to be produced.

It is known that a critical issue with automatic plants for the manufacture of disposable capsules is the precision of dosing and the speed at which the capsule is filled with the food substance.

Single and multiple dosers, static or moving, in-line or on carousels, form part of the prior art, and are following the trend of becoming increasingly complex in the quest for greater production line speed and therefore overall plant profitability.

Such traditional plants for filling disposable capsules for the preparation of beverages are known to involve specific complex dedicated devices for the exact positioning of the doser in relation to the capsule for the time required to fill the capsule with the exact dosage of the food substance.

BRIEF SUMMARY OF THE INVENTION

There is therefore a need to simplify the design of traditional plants for filling disposable capsules for the preparation of known beverages.

The technical problem addressed by the present invention is, therefore, to develop an apparatus for filling disposable capsules for the preparation of beverages which eliminates the technical disadvantages from the prior art.

Within the scope of this technical problem, an object of the invention is to create an apparatus for filling disposable capsules for the preparation of beverages which allows continuous movement of the transport line of the capsules to be filled.

A further object of the invention is to create an apparatus for filling disposable capsules for the preparation of beverages which has an exact positioning of the doser with respect to the capsule.

A further object of the invention is to create an apparatus for filling disposable capsules for the preparation of beverages with a high production speed.

A further object of the invention is to create an apparatus for filling disposable capsules for the preparation of beverages which is simple and compact, in order to limit the overall dimensions of the production line.

According to the present invention, the technical problem is solved, and also the above and other objects are achieved, by creating an apparatus for filling disposable capsules for the preparation of beverages comprising a belt production line in continuous advancement comprising a plurality of seats arranged at a constant pitch p for housing a plurality of capsules to be filled, a filling unit above said belt production line comprising a plurality of dosers for dosing the food substance, characterised in that said plurality of dosers is configured in at least one rectilinear row of dosers and said plurality of seats is configured for the transit below said filling unit in at least one rectilinear row of seats, in that said plurality of dosers is arranged at a constant pitch P greater than the constant pitch of said plurality of housing seats, and in that a coordinated movement means is envisaged, configured to impose on said rectilinear row of dosers and on said rectilinear row of seats a null relative speed in a first and respectively at least a second distinct time interval, during the unloading of the food substance from said rectilinear row of dosers into a first series and respectively at least a second series of said capsules to be filled present in said rectilinear row of seats.

The invention also relates to a method for filling disposable capsules for the preparation of beverages, characterised in that a belt production line is provided, comprising a plurality of seats arranged to house a plurality of capsules to be filled, to make said plurality of seats advance continuously at a constant speed making them transit, ordered in at least one rectilinear row of seats arranged at a constant pitch p, below a filling unit comprising a plurality of dosers for dosing the food substance ordered in at least one rectilinear row of dosers arranged at a constant pitch P greater than the constant pitch p of said plurality of housing seats, and filling the capsules present in all the seats in transit subjecting said filling unit to a coordinated movement with the movement of said seats wherein between said rectilinear row of dosers and said rectilinear row of seats a null relative zero speed is imposed during the unloading of the food substance from said rectilinear row of dosers into said capsules to be filled present in said rectilinear row of seats.

Other features of the present invention are also defined in the subsequent dependent claims. There is therefore a need to simplify the design of traditional plants for filling disposable capsules for the preparation of known beverages.

The technical problem addressed by the present invention is, therefore, to develop an apparatus for filling disposable capsules for the preparation of beverages which eliminates the technical disadvantages from the prior art.

Within the scope of this technical problem, an object of the invention is to create an apparatus for filling disposable capsules for the preparation of beverages which allows continuous movement of the transport line of the capsules to be filled.

A further object of the invention is to create an apparatus for filling disposable capsules for the preparation of beverages which has an exact positioning of the doser with respect to the capsule.

A further object of the invention is to create an apparatus for filling disposable capsules for the preparation of beverages with a high production speed.

A further object of the invention is to create an apparatus for filling disposable capsules for the preparation of beverages which is simple and compact, in order to limit the overall dimensions of the production line.

According to the present invention, the technical problem is solved, and also the above and other objects are achieved, by creating an apparatus for filling disposable capsules for the preparation of beverages comprising a belt production line in continuous advancement comprising a plurality of seats arranged at a constant pitch p for housing a plurality of capsules to be filled, a filling unit above said belt production line comprising a plurality of dosers for dosing the food substance, characterised in that said plurality of dosers is configured in at least one rectilinear row of dosers and said plurality of seats is configured for the transit below said filling unit in at least one rectilinear row of seats, in that said plurality of dosers is arranged at a constant pitch P greater than the constant pitch of said plurality of housing seats, and in that a coordinated movement means is envisaged, configured to impose on said rectilinear row of dosers and on said rectilinear row of seats a null relative speed in a first and respectively at least a second distinct time interval, during the unloading of the food substance from said rectilinear row of dosers into a first series and respectively at least a second series of said capsules to be filled present in said rectilinear row of seats.

The invention also relates to a method for filling disposable capsules for the preparation of beverages, characterised in that a belt production line is provided, comprising a plurality of seats arranged to house a plurality of capsules to be filled, to make said plurality of seats advance continuously at a constant speed making them transit, ordered in at least one rectilinear row of seats arranged at a constant pitch p, below a filling unit comprising a plurality of dosers for dosing the food substance ordered in at least one rectilinear row of dosers arranged at a constant pitch P greater than the constant pitch p of said plurality of housing seats, and filling the capsules present in all the seats in transit subjecting said filling unit to a coordinated movement with the movement of said seats wherein between said rectilinear row of dosers and said rectilinear row of seats a null relative zero speed is imposed during the unloading of the food substance from said rectilinear row of dosers into said capsules to be filled present in said rectilinear row of seats.

Other features of the present invention are also defined in the subsequent dependent claims.

Other advantageous embodiments and combinations of features come out from the detailed description below and the entirety of the claims.

BRIEF DESCRIPTION OF THE SEVERAL VIEWS OF THE DRAWINGS

Further advantages, features, and details of the various embodiments of this disclosure will become apparent from the ensuring description of a preferred exemplary embodiment and with the aid of the drawings. The features and combinations of features recited below in the description, as well as the features and feature combination shown after that in the drawing description or in the drawings alone, may be used not only in the particular combination received, but also in other combinations on their own, without departing from the scope of the disclosure.

The drawings used to explain the embodiments wherein.

In the FIGS., the same components are given the same reference symbols.

DETAILED DESCRIPTION OF THE INVENTION

Figure 1A:
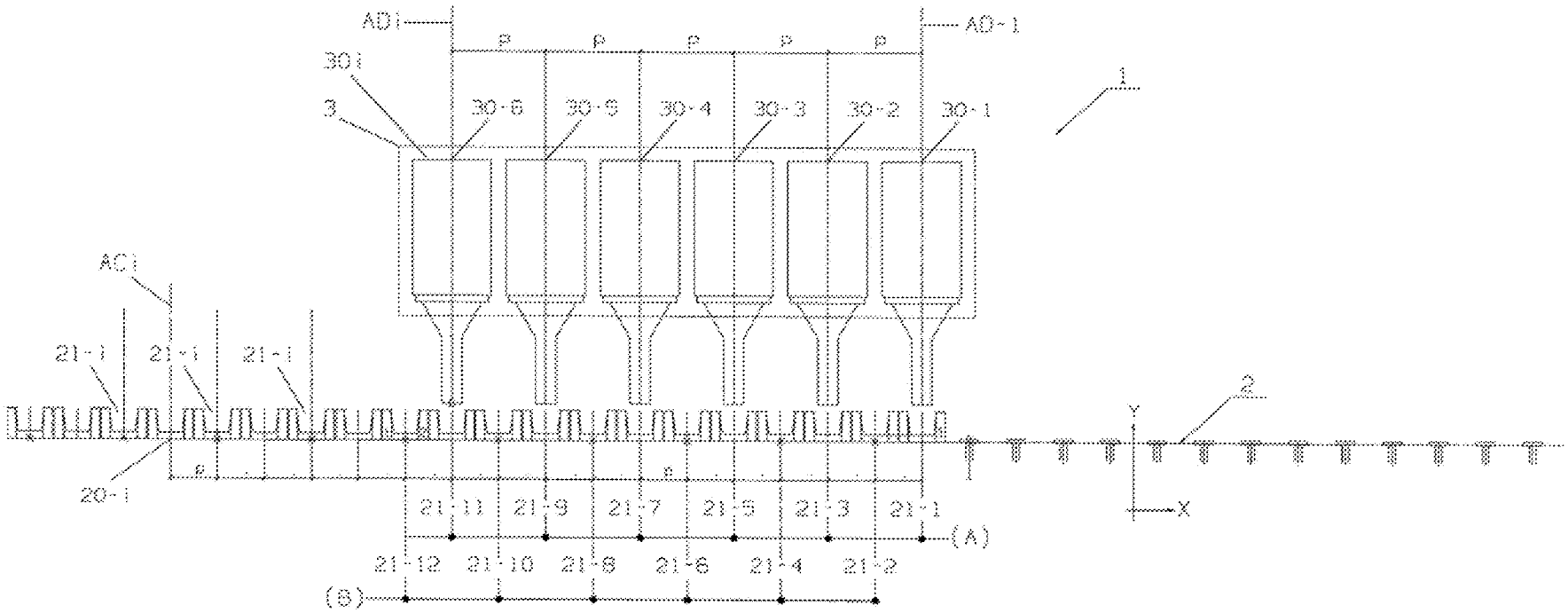
FIG. 1A-F schematically show the relative movement sequence of the filling unit, the dosers and the production line with the capsules to be filled, and the filling sequence of the capsules.

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that at least one of "A, B, and C" should not be understood as including only one of A, only one of B, only one of C, or any combination of A, B, and C.

With reference to the above-mentioned FIGS., an apparatus for filling disposable capsules for the preparation of beverages is denoted overall by reference number 1.

In the FIGS., an apparatus 1 substantially comprising a belt production line 2 and an upper filling unit 3 is shown.

The production line 2 supports a rectilinear row of housing seats 20*i* for the capsules to be filled 21*i*, which seats are provided with an axis ACi at a constant pitch p.

The linear belt production line 2 is expediently moved by movement means, not shown in the FIG., in continuous advancement at constant speed in the direction X.

The upper filling unit 3 comprises a plurality of dosers 30*i* for dosing the food substance, which dosers are expediently fed by food substances not shown in the FIG..

Said plurality of dosers 30*i* is configured in at least one rectilinear row of dosers 30*i* and said plurality of seats 20*i* is configured for transit below the filling unit 3 in at least one rectilinear row of seats 20*i*.

The upper filling unit 3 is mounted in the production plant above the belt production line 2 with the possibility of a controlled linear movement in the direction X; the plurality of dosers 30*i* is mounted in line in the filling unit 3 and in axial alignment with the production line 2, with the possibility of a controlled linear movement in the direction Y, orthogonal to the direction X.

Appropriate movement means—typically permanent magnet DC electric motors and electronic control units, e.g. encoders—implement the coordinated movement of the upper filling unit 3 in the direction X and the plurality of dosers 30*i* in the direction Y.

Such coordinated movement means are configured to impose on the rectilinear row of dosers 30*i* and the rectilinear row of seats 20*i* a null relative speed in a first and respectively at least a second separate time interval during the unloading of the food substance from the rectilinear row of dosers 30*i* into a first series and respectively at least a second series of the capsules to be filled 21*i* present in the rectilinear row of seats 20*i*.

Advantageously, according to the present invention, the plurality of dosers 30*i* is positioned on the upper filling unit 3 with an axis ADi at a constant pitch P greater than the constant pitch p of the housing seats 20*i* for the capsules on the belt line 2.

Expediently, the constant pitch P of the plurality of dosers 30*i* is an integer multiple of the constant pitch p of the plurality of seats 20*i*: P=nP; typically but not exclusively, in the preferred but not exclusive embodiment described and illustrated herein P=2p.

The operation of the apparatus for filling disposable capsules for the preparation of beverages (1) according to the invention is clear from what is described and illustrated sequentially in FIGS. 1A to 1F and, in particular, is substantially as follows.

FIG. 1A shows the belt production line 2 and the filling unit 3 in the initial position of the filling cycle.

The plurality of receiving seats 20*i* is positioned on the belt production line 2 with pitch p between the respective vertical axes ACi.

The capsules to be filled 21*i* are placed in the corresponding seats 20*i* with their axis coinciding with the axis ACi.

For the sake of clarity and descriptive simplicity and with reference to the FIG. and as an example of the first preferred solution, 12 capsules to be filled 21*i* at pitch p are shown, in sequence numbered from 21-1 to 21-12, subdivided into a first series A of capsules with an odd index and a second series B of capsules with an even index.

Consequently, the filling unit 3 is shown with 6 dosers 30*i* at pitch P=2p, sequentially numbered from 30-1 to 30-6, where each doser 30*i* has its own axis ADi coinciding with the axis ACi of the underlying capsule to be filled 21*i*: in the initial situation, the first doser 30-1 has its own axis AD-1 coinciding with the axis AC-1 of the first capsule 21-1 of the first series A of capsules.

The belt production line 2 moves linearly at constant speed in the direction X.

Suitable movement and control means implement the coordinated movement of the rectilinear row of dosers 30*i* with the rectilinear row of seats 20*i* when the axis ACi of the first capsule of the first series of capsules to be filled 21*i* coincides with the axis ADi of the first of the plurality of dosers (30*i*).

These movement and control means move the filling unit 3 in the direction X and coordinate its speed with the speed of line 2 so that the speed of the filling unit 3 relative to the line 2 is zero.

Figure 1B:
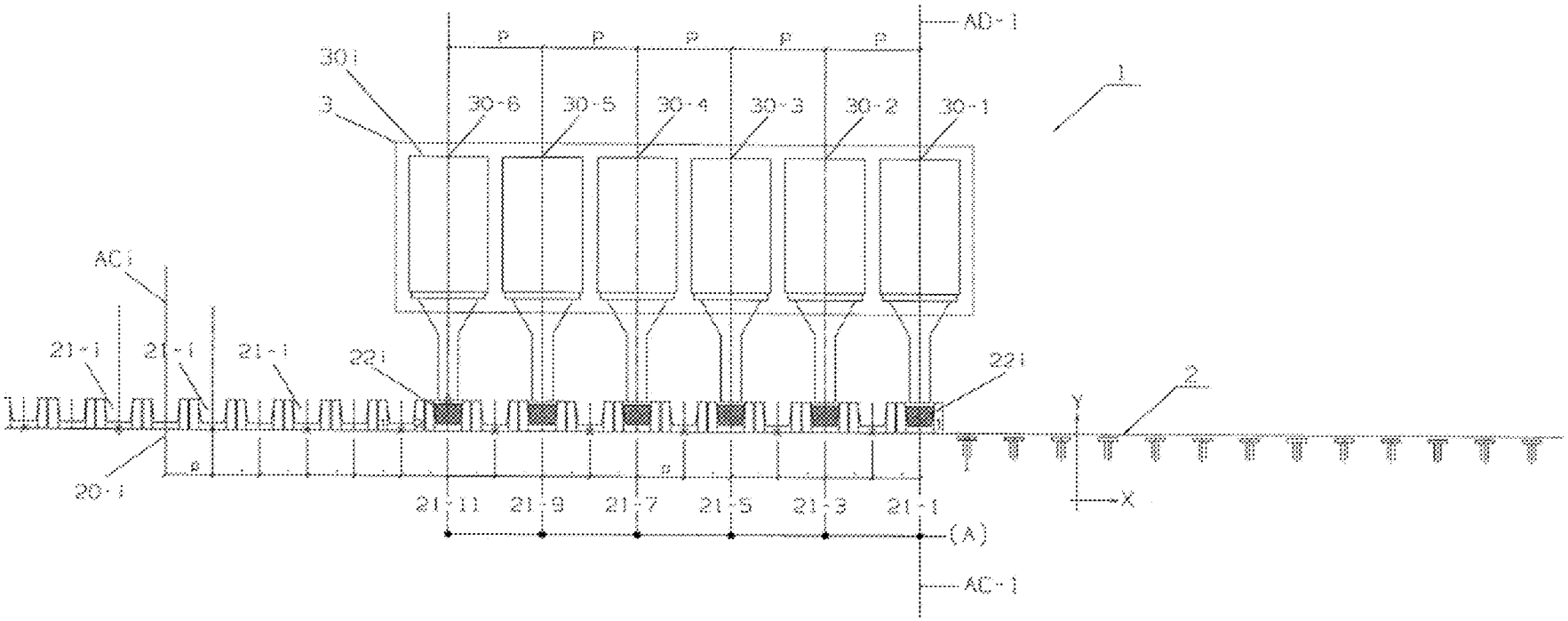

FIG. 1B shows a first phase of filling the capsules of the first series A with an odd index 21*i*: the first doser 30-1 is in axial alignment with the first capsule of the series A with an odd index 21-1, the second doser 30-2 is in axial alignment with the second capsule with an odd index 21-3, and so on up to the sixth doser 30-6 in axial alignment with the sixth capsule with an odd index 21-11.

The belt production line 2 and the filling unit 3 move at constant speed substantially rigidly coupled in the direction X, the movement means implement a controlled movement of the dosers 30*i* along the direction Y approaching the below-arranged capsules to be filled 21*i* in the rectilinear row of seats 20*i*, and appropriate dosing means discharge the programmed dose of the food substance through the dosers 30*i* into the below-arranged capsules to be filled 21*i*.

The discharge of the food substance from the plurality of dosers 30*i* of the filling unit 3 into the plurality of capsules to be filled 21*i* in the rectilinear row of seats 20*i* occurs when the axis ACi of the first capsule of the first series of the plurality of capsules to be filled 21*i* coincides with said axis ADi of the first of the plurality of dosers (30*i*).

The filled capsules are indicated in the FIG. by reference 22*i*.

Figure 1C:
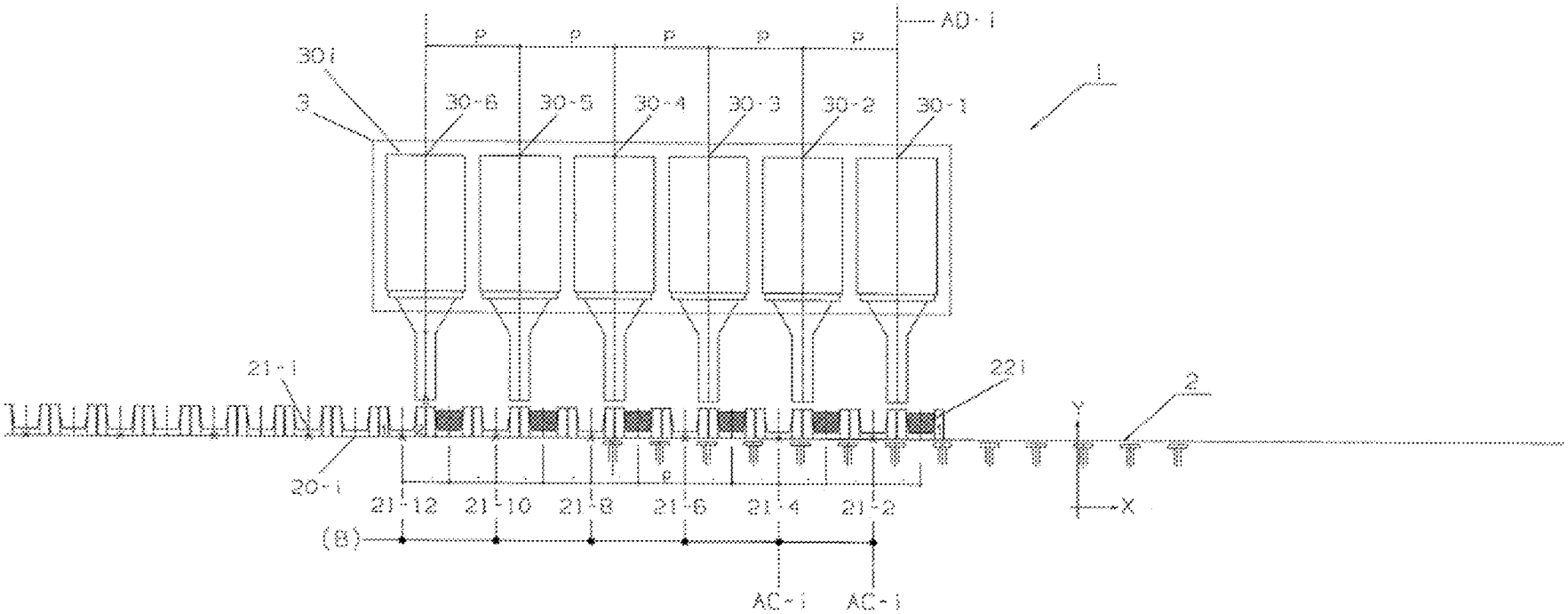

FIG. 1C shows how, following the filling of a first series A of capsules with an odd index 21*i*, the coordinated movement means of the doser 3 implement a controlled movement of the dosers 30*i* along the direction Y away from the filled capsules 22*i*.

While the belt production line 2 continues movement in the direction X at a constant speed, advantageously and according to the present invention, the coordinated movement means of the filling unit 3 move the filling unit 3 in the direction X but in a backward direction with respect to the movement of the line 2, reducing the synchronisation time of the axes ADi of the dosers 30*i* with the corresponding axes ACi of the capsules to be filled 21*i* of the second series B of capsules with an even index 21*i*, arranged at a pitch p from the corresponding axes ACi of the filled capsules 22*i* of the first series A of capsules with an odd index.

The movement means imposes a relative backward displacement of the filling unit 3 and the rectilinear row of dosers 31*i* with respect to the production line 2 and the rectilinear row of seats 20*i* between the filling of a first series A of a plurality of capsules to be filled with an odd index 21*i* and the filling of a second series B of a plurality of capsules to be filled with an even index 21*i* thus equal to the pitch p of the plurality of housing seats (20*i*).

Figure 1D:
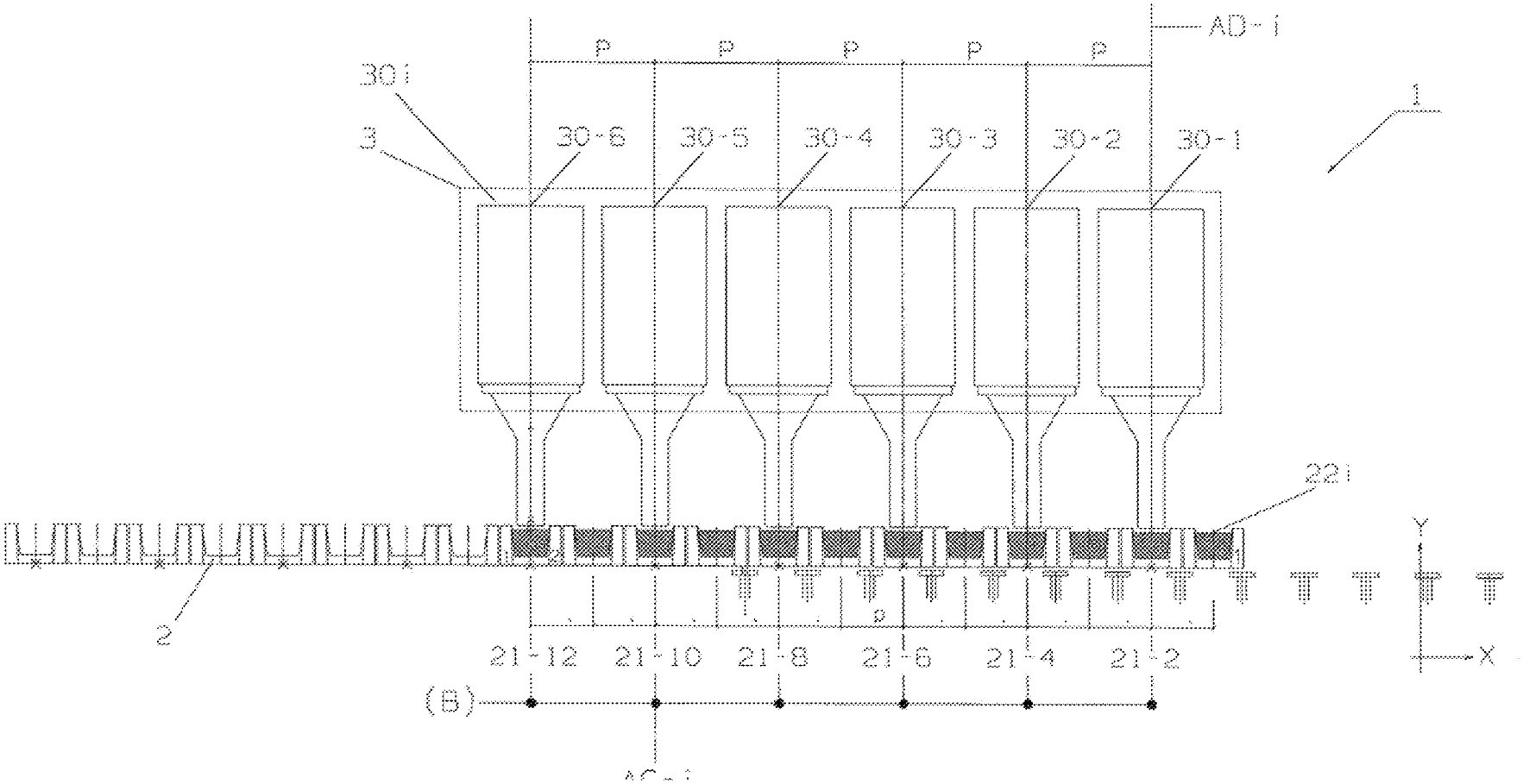

FIG. 1D shows the filling unit 3 in synchrony with the line 2: the axes ADi of the dosers 30*i* have been synchronised with the corresponding axes ACi of the capsules to be filled 21*i* of the second series B of capsules with an even index: the first doser 30-1 is in axial alignment with the first capsule of the series B with an even index 21-2, the second doser 30-2 is in axial alignment with the second capsule with an even index 21-4, and so on until the sixth doser 30-6 in axial alignment with the sixth capsule with an even index 21-12.

The movement means of the doser 3 synchronised the speed in the direction X of the filling unit 3 with the corresponding constant speed of the line 2 so that the relative speed was null.

The belt production line 2 and the filling unit 3 moved at a constant speed substantially rigidly coupled in the direction X.

The movement means implemented a controlled movement of the dosers 30*i* along the direction Y approaching the capsules to be filled 21*i* of the first series B of capsules, after which the appropriate dosing means discharged the programmed dose of the food substance through the dosers 30*i* into the below-arranged capsules to be filled 21*i*.

The filled capsules are indicated in the FIG. by reference 22*i*.

Figure 1E:
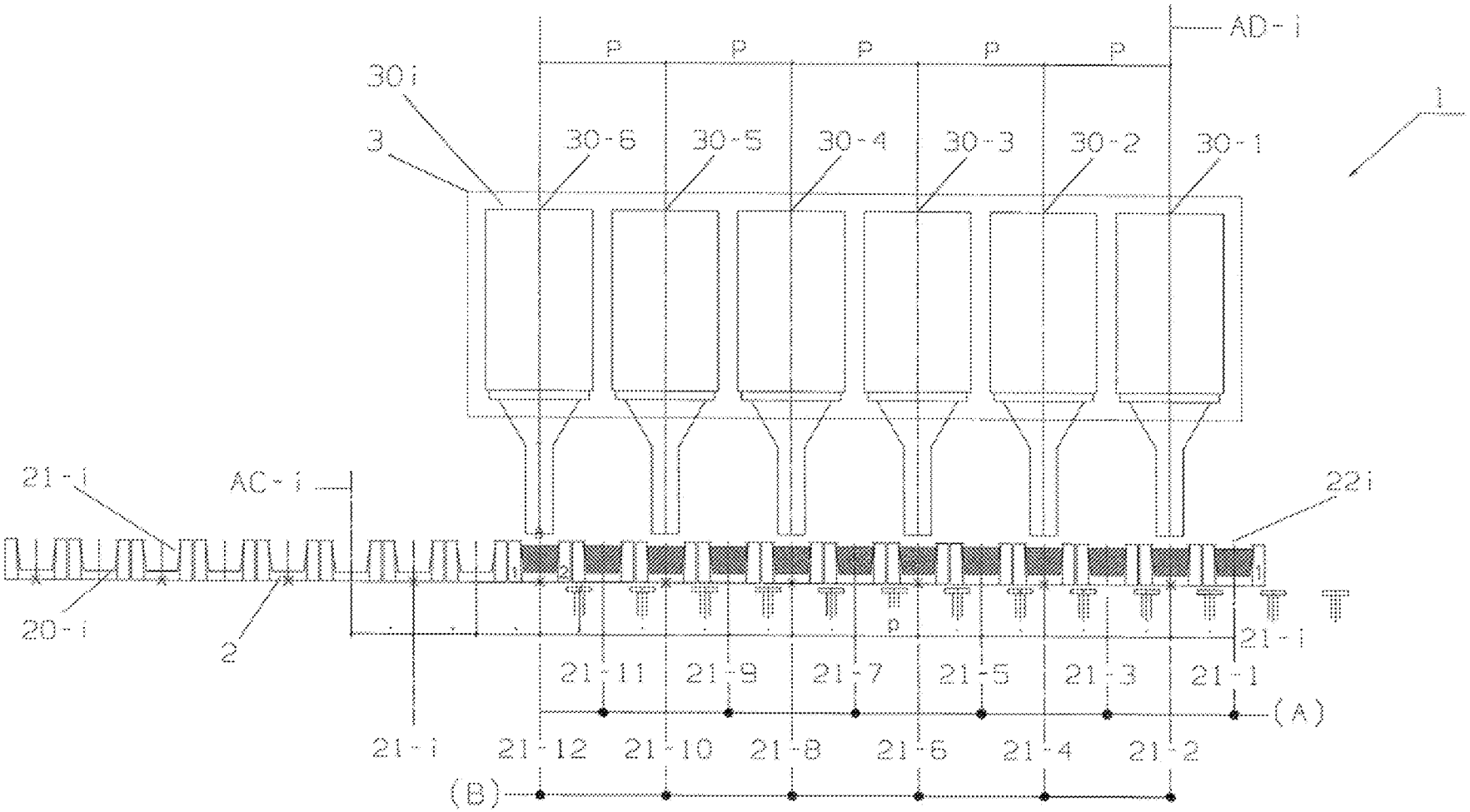

FIG. 1E shows how, following the filling of a second series B of capsules 21*i*, the coordinated movement means of the filling unit 3 implement a controlled movement of the dosers 30*i* along the direction Y away from the filled capsules 22*i*; while the belt production line 2 continues the movement in the direction X at a constant speed.

Figure 1F:
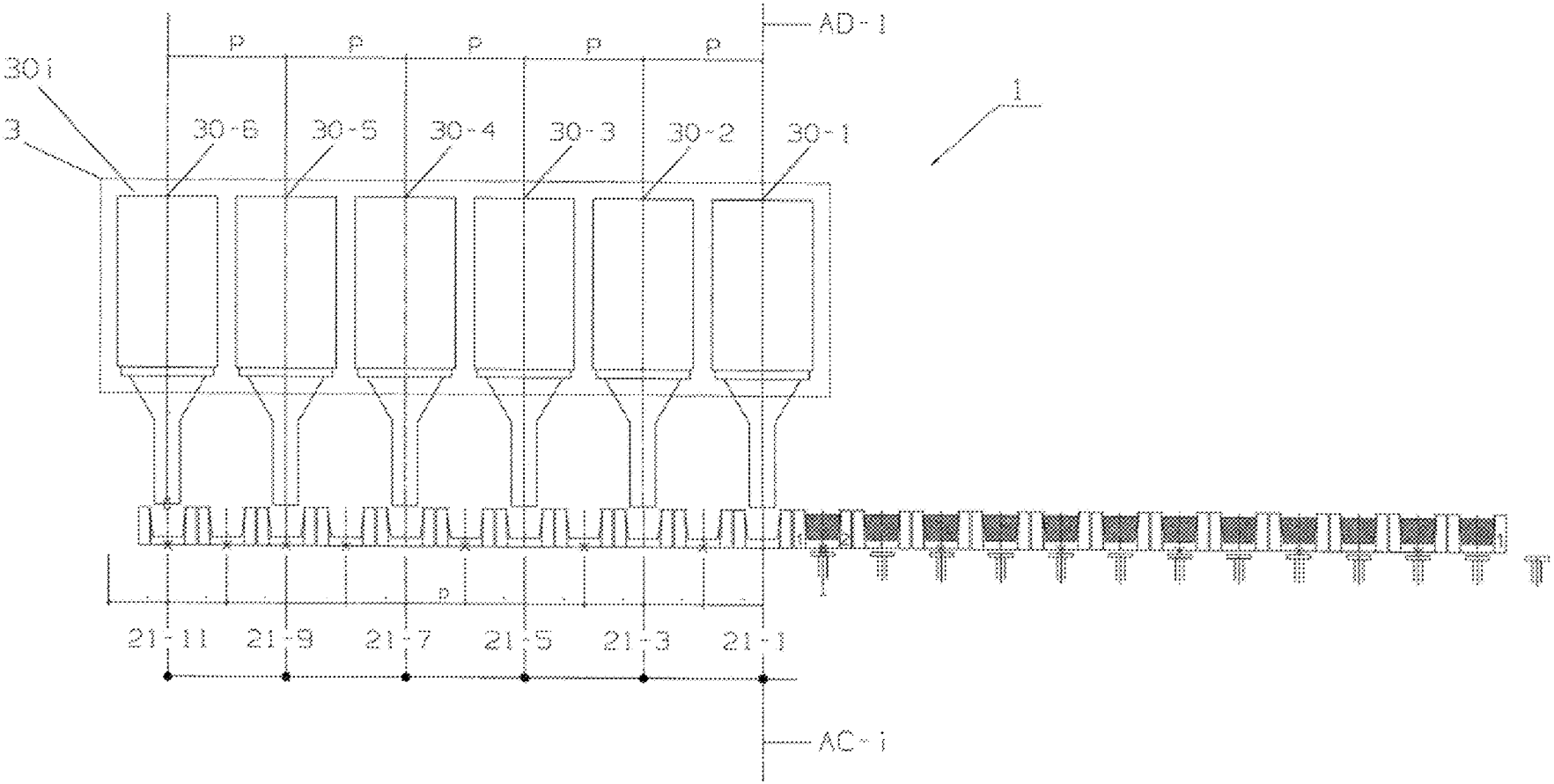

In FIG. 1F, it is shown how advantageously, according to the present invention, the coordinated movement means of the filling unit 3 move the filling unit 3 in the direction X but in a backward direction with respect to the continuous movement at constant speed of the line 2, bringing the filling unit 3 back to its initial position illustrated in FIG. 1A.

The relative sliding with speed of opposite sign of the line 2 and of the filling unit 3 brings a second series A of capsules to be filled with an odd index 21*i* with their axes ACi into axial alignment with the axes ADi of the above-arranged dosers 30*i*.

Advantageously, according to the present invention, the control and movement means of the filling unit 3 register this axial alignment, implement the movement of the filling unit and synchronise its speed in the direction X with the constant speed of the line 2 when the axis AC-1 of the first capsule to be filled 21-1 of the second series of capsules A following the last-filled capsule 22*i* of the second series B of capsules coincides with the axis AD-1 of the first doser 30-1 of the filling unit 3.

The control and movement means impose a relative backward displacement of the filling unit 3 and of the row of dosers 31*i* with respect to the production line 2 and the rectilinear row of seats 20*i* between the filling of a first series A and a second series B and a subsequent first series A of a plurality of capsules to be filled 21*i* thus equal to the sum of the pitches p of the first series A and the second series B deducted by a unit p, which has already been removed between the filling of the first series A and the filling of the second series B.

The production cycle resumes according to that shown, illustrated and described in FIG. 1A and following.

Modifications and variations, in addition to those already mentioned, are of course possible, that is to say, for example, with respect to the multiple n of the pitch P=np, and the number of dosers 30*i* of the filling unit 3.

In practice, it has been found that an apparatus for filling disposable capsules for the preparation of beverages according to the invention is particularly advantageous due to the fact that it allows continuous movement of the transport line of the capsules to be filled, ensures an exact positioning of the doser with respect to the capsule, has a high production speed due to the plurality of simultaneously activated dosers, and is simple and has limited overall dimensions.

An apparatus for filling disposable capsules for the preparation of beverages designed in this way is suitable for numerous modifications and variations, all of which fall within the scope of the inventive concept; moreover, all details are replaceable by technically equivalent elements.

In practice, any materials and also dimensions can be used, according to requirements and the prior the art.

Since the devices and methods described in detail above are examples of embodiments, they can be modified to a wide extent by the skilled person in the usual manner without departing from the scope of the invention. In particular, the mechanical arrangements and the proportions of the individual elements with respect to each other are merely exemplary. Some preferred embodiments of the apparatus according to the invention have been disclosed above. The invention is not limited to the solutions explained above, but the innovative solutions can be applied in different ways within the limits set out by the claims.

The invention claimed is:

1. An apparatus for filling disposable capsules for the preparation of beverages comprising a belt production line configured for a continuous advancement along a transport direction comprising a plurality of seats arranged at a constant pitch, wherein the seats are provided with an axis at the constant pitch, for housing a plurality of capsules to be filled, a filling unit above said belt production line comprising a plurality of dosers for dosing the food substance, wherein said plurality of dosers is configured in at least one rectilinear row of dosers and said plurality of seats is configured for the transit below said filling unit in at least one rectilinear row of seats, wherein said rectilinear row of seats is configured to have a continuous rectilinear advancement at constant speed, wherein said plurality of dosers is arranged with an axis at a constant pitch greater than the constant pitch of said plurality of seats, wherein the constant pitch of the plurality of dosers is an integer multiple of the constant pitch of said plurality of seats, wherein the filling unit is linearly movable along the transport direction and wherein a coordinated movement means is provided, configured to impose on said rectilinear row of dosers and on said rectilinear row of seats a null relative speed in a first and respectively at least a second distinct time intervals, during the unloading of the food substance from said rectilinear row of dosers into a first series and respectively at least a second series of said capsules to be filled present in said rectilinear row of seats.

2. The apparatus for filling disposable capsules for the preparation of beverages according to claim 1, said constant pitch of said plurality of dosers of said filling unit being equal to twice said constant pitch of said plurality of seats of said belt production line.

3. The apparatus for filling disposable capsules for the preparation of beverages according to claim 1, said movement means being configured to actuate the coordinated movement of said rectilinear row of dosers with said rectilinear row of seats when the axis of the first capsule of said first series of capsules to be filled coincides with the axis of the first of said plurality of dosers.

4. The apparatus for filling disposable capsules for the preparation of beverages according to claim 1, the apparatus being configured to unload the food substance from said plurality of dosers into said plurality of capsules to be filled in said rectilinear row of seats when said axis of said first capsule of said first series of capsules to be filled coincides with said axis of said first one of said plurality of dosers.

5. The apparatus for filling disposable capsules for the preparation of beverages according to claim 1, wherein the capsules of said first series of said one plurality of capsules to be filled have an odd index and the capsules of said second series of said one plurality of capsules have an even index, wherein said movement means imposing a relative backward displacement of said rectilinear row of dosers with respect to said rectilinear row of seats between the filling of said first series of said one plurality of capsules to be filled with an odd index and the filling of said second series of said one plurality of capsules to be filled with an even index equal to said pitch of said plurality of seats.

6. The apparatus for filling disposable capsules for the preparation of beverages according to claim 5, said movement means being configured to impose a relative backward displacement of said row of dosers with respect to said rectilinear row of seats between the occurred filling of said one first series and of said one second series and the filling of a subsequent first series of said plurality of capsules to be filled equal to the sum of said pitches of said first series and of said first series minus one pitch.

7. A method for filling disposable capsules for the preparation of beverages, wherein a belt production line is provided, comprising a plurality of seats arranged to house a plurality of capsules to be filled, to make said plurality of seats advance continuously at a constant speed making them transit along a transport direction, ordered in at least one rectilinear row of seats arranged at a constant pitch, wherein the seats are provided with an axis at the constant pitch and wherein said rectilinear row of seats has a continuous rectilinear advancement at constant speed, below a filling unit comprising a plurality of dosers for dosing the food substance ordered in at least one rectilinear row of dosers arranged with an axis at a constant pitch greater than the constant pitch of said plurality of seats, wherein the constant pitch of the plurality of dosers is an integer multiple of the constant pitch of said plurality of seats, the filling unit being linearly movable along the transport direction and filling the capsules present in all the seats in transit subjecting said filling unit to a coordinated movement with the movement of said seats wherein between said rectilinear row of dosers and said rectilinear row of seats a null relative speed is imposed during the unloading of the food substance from said rectilinear row of dosers into said capsules to be filled present in said rectilinear row of seats.

8. The method for filling disposable capsules for the preparation of beverages according to claim 7, wherein a relative backward displacement of said rectilinear row of dosers with respect to said rectilinear row of seats is imposed between the filling of a first series of a plurality of capsules to be filled and the filling of a second series of a plurality of capsules to be filled.

9. The method for filling disposable capsules for the preparation of beverages according to claim 8, said relative backward displacement of said row of dosers with respect to said rectilinear row of seats being imposed between the occurred filling of said first series and of said second series and the filling of a subsequent first series of said plurality of capsules to be filled equal to the sum of said pitches of said first series and of said first series minus one pitch.

10. The method for filling disposable capsules for the preparation of beverages according to claim 8, the relative backward displacement being equal to said pitch of said plurality of seats.

* * * * *